US010429755B2

(12) United States Patent
Murakami et al.

(10) Patent No.: US 10,429,755 B2
(45) Date of Patent: Oct. 1, 2019

(54) WHITE TONER FOR ELECTROSTATIC IMAGE DEVELOPMENT, ELECTROSTATIC IMAGE DEVELOPER, TONER CARTRIDGE, PROCESS CARTRIDGE, IMAGE FORMING APPARATUS, AND IMAGE FORMING METHOD

(71) Applicant: FUJI XEROX CO., LTD., Tokyo (JP)

(72) Inventors: Tsuyoshi Murakami, Kanagawa (JP); Tsutomu Furuta, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/986,230

(22) Filed: May 22, 2018

(65) Prior Publication Data

US 2019/0196348 A1 Jun. 27, 2019

(30) Foreign Application Priority Data

Dec. 22, 2017 (JP) ..... 2017-246589

(51) Int. Cl.
*G03G 9/09* (2006.01)
*G03G 9/087* (2006.01)
*G03G 9/08* (2006.01)

(52) U.S. Cl.
CPC ..... *G03G 9/0902* (2013.01); *G03G 9/0819* (2013.01); *G03G 9/08711* (2013.01); *G03G 9/08755* (2013.01); *G03G 9/0926* (2013.01)

(58) Field of Classification Search
CPC ..... G03G 9/0902; G03G 9/0926
See application file for complete search history.

(56) References Cited

U.S. PATENT DOCUMENTS

2016/0062313 A1* 3/2016 Matsumoto ..... G03G 21/1867 399/90
2018/0074422 A1* 3/2018 Nakajima ..... G03G 9/0926

FOREIGN PATENT DOCUMENTS

JP H01-105961 A 4/1989
JP 2002-108021 A 4/2002

OTHER PUBLICATIONS

Windholz, M, et al, ed., The Merck Index, ninth edition, Merck & Co., Inc., NJ (1976), pp. 1219-1220, No. 9182. (Year: 1976).*

* cited by examiner

*Primary Examiner* — Janis L Dote
(74) *Attorney, Agent, or Firm* — Oliff PLC

(57) ABSTRACT

A white toner for electrostatic image development includes white toner particles containing a binder resin and a white pigment. When in a circularity distribution of the white pigment determined by sectional observation of the white toner particles, the cumulative 10% circularity from the smaller side is C10, and the cumulative 50% circularity is C50, the following formula (1) and formula (2) are satisfied.

$0.900 \leq C50 \leq 1.000$ Formula (1):

$1.00 \leq C50/C10 \leq 1.13$ Formula (2):

13 Claims, 2 Drawing Sheets

WHITE TONER FOR ELECTROSTATIC IMAGE DEVELOPMENT, ELECTROSTATIC IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2017-246589 filed Dec. 22, 2017.

BACKGROUND

(i) Technical Field

The present invention relates to a white toner for electrostatic image development, an electrostatic image developer, a toner cartridge, a process cartridge, an image forming apparatus, and an image forming method.

(ii) Related Art

White toners each containing a binder resin and a white pigment have been known as white toners used for forming images in an electrophotographic system.

When colored images are formed directly on a colored recording medium or a transparent recording medium, the colored images may have poor color reproducibility. Therefore, for the purpose of enhancing the color reproducibility of colored images, a white image (generally a white image with a density of 100%, that is, a white solid image) may be formed as a hiding layer which hides the color of the colored recording medium or suppresses the transparency of the transparent recording medium. The hiding properties of the white image are exhibited by reflection of the light incident on the white image without transmission. Therefore, it is proposed, as a measure for forming a white image with excellent hiding properties, to use a white pigment having a high refractive index, use a white pigment having a primary particle diameter of about ½ of the wavelength of incident light, increase the amount of white pigment used in a white image, increase the thickness of a white image, or the like.

SUMMARY

A recording medium (for example, a resin film) having an image formed thereon may be used as a package or label of an article. In this case, the recording medium having an image formed thereon is curved along the shape of the article. In addition, when a recording medium on which a white image serving as a hiding layer and a colored image are laminated is curved, the color reproducibility of the colored image may be decreased. This phenomenon is supposed to occur due to a large quantity of transmitted light, not reflected light, because light is incident on the white image from various directions in a curved state. This phenomenon tends to become remarkable by exposure of the recording medium having an image formed thereon to mechanical stress, and tends to more easily occur with increasing thickness of the white image or increasing amount of the white pigment in the white image (that is, decreasing relative amount of a binder resin). Thus, it is supposed that a gap occurs between the colored image and the white image due to a decrease in adhesion between the colored image and the white image. This influences the curved state and thus decreases the color reproducibility of the colored image.

According to an aspect of the invention, there is provided a white toner for electrostatic image development, the toner including white toner particles containing a binder resin and a white pigment. When in a circularity distribution of the white pigment determined by sectional observation of the white toner particles, the cumulative 10% circularity from the smaller side is C10, and the cumulative 50% circularity is C50, the following formula (1) and formula (2) are satisfied.

$$0.900 \leq C50 \leq 1.000 \quad \text{Formula (1):}$$

$$1.00 \leq C50/C10 \leq 1.13 \quad \text{Formula (2):}$$

BRIEF DESCRIPTION OF THE DRAWINGS

Exemplary embodiments of the present invention will be described in detail based on the following figures, wherein.

DETAILED DESCRIPTION

Figure 1:
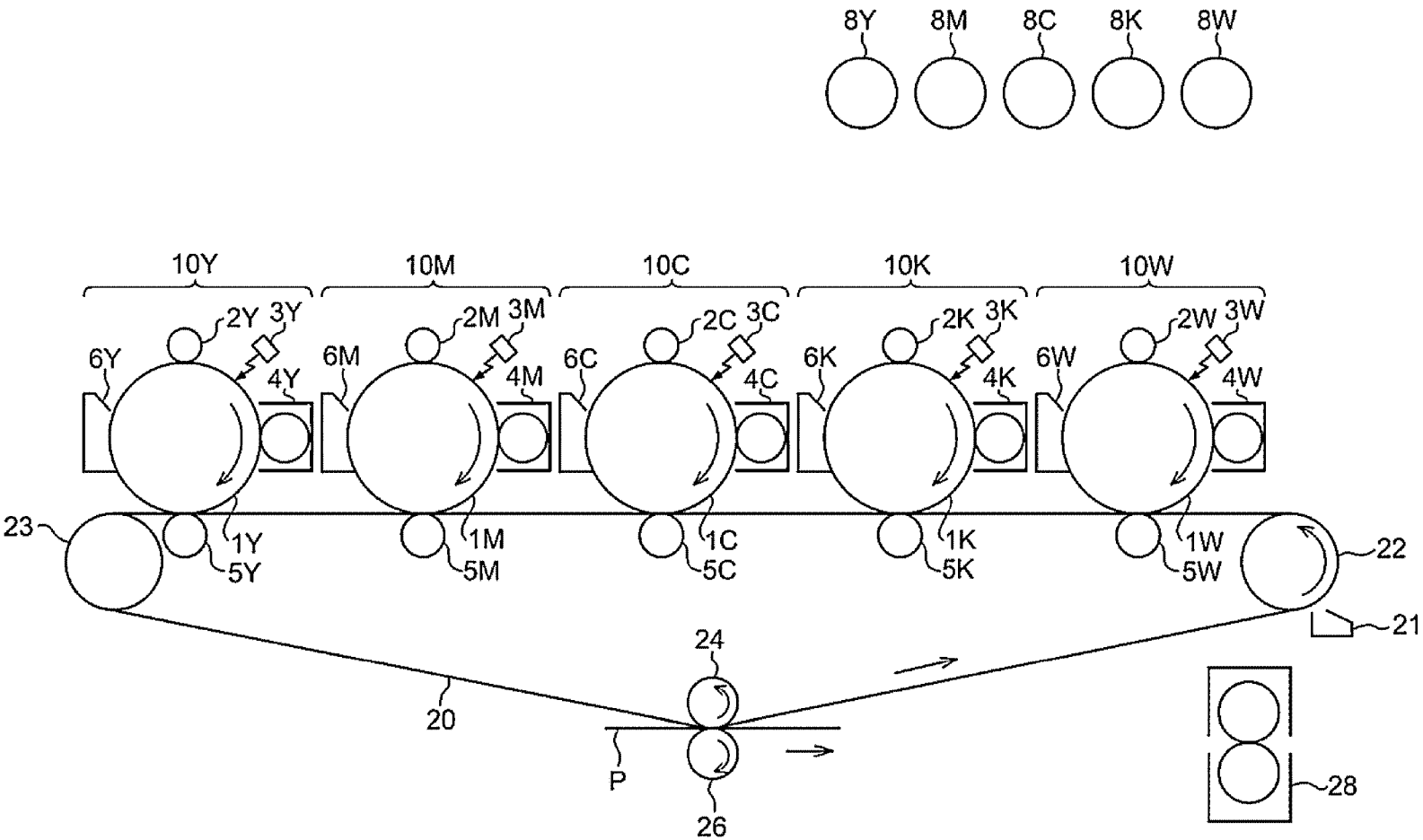
FIG. 1 is a schematic configuration diagram showing an example of an image forming apparatus according to an exemplary embodiment of the present invention.

Exemplary embodiments of the present invention are described below. The description of the exemplary embodiments and examples is only illustrative and does not limit the scope of the present invention.

In the present disclosure, when the amount of each of the components in a composition is described, the amount of plural substances corresponding to each of the components in the composition represents the total amount of the plural substances present in the composition unless otherwise specified.

In the present disclosure, a numerical value range expressed by using "to" represents a range including numerical values described before and after the "to" as the minimum value and the maximum value, respectively.

In the present disclosure, a "toner for electrostatic image development" is also simply referred to as a "toner", a "white toner for electrostatic image development" is also simply referred to as a "white toner", and an "electrostatic image developer" is also simply referred to as a "developer".

<White Toner for Electrostatic Image Development>

A white toner for electrostatic image development according to an exemplary embodiment of the present invention contains white toner particles containing a binder resin and a white pigment. When in a circularity distribution of the white pigment determined by sectional observation of the white toner particles, the cumulative 10% circularity from the smaller side is C10, and the cumulative 50% circularity is C50, the following formula (1) and formula (2) are satisfied.

$$0.900 \leq C50 \leq 1.000 \quad \text{Formula (1):}$$

$$1.00 \leq C50/C10 \leq 1.13 \quad \text{Formula (2):}$$

The formula (1) indicates that the white pigment contained in the white toner particles has high circularity, and the formula (2) indicates that the white pigment contained in the white toner particles has a narrow circularity distribution.

The white toner according to the exemplary embodiment contains the white toner particles containing the white pigment which has high circularity (that is, has few corners) and a narrow circularity distribution. The white pigment contained in the white toner has high shape isotropy of particles, and thus a high scattering rate can be exhibited regardless of the incidence direction of light. Therefore, it is supposed that a white image containing the white pigment has excellent hiding properties even in a curved state where light is incident in various directions, and thus a decrease in color reproducibility of a colored image is suppressed. When C50 is less than 0.900 or when C50/C10 exceeds 1.13, the particles of the white pigment are unsatisfactory in shape isotropy and light scattering rate, and thus the hiding properties of the white image are supposed to be unsatisfactory for suppressing a decrease in color reproducibility of the colored image in a curved state.

From the above viewpoint, in the exemplary embodiment, C50 relating to the circularity of the white pigment is 0.900 or more and 1.000 or less, and is C50/C10 is 1.13 or less. In addition, C50/C10 is preferably as small as possible, ideally 1.00, and actually over 1.00.

Further, C50 relating to the circularity of the white pigment more preferably satisfies the formula (1'): $0.925 \leq C50 \leq 1.000$, and still more preferably satisfies the formula (1"): $0.950 \leq C50 \leq 1.000$. In addition, C50/C10 relating to the circularity of the white pigment more preferably satisfies the formula (2'): $1.00 \leq C50/C10 \leq 1.08$, and still more preferably satisfies the formula (2"): $1.00 \leq C50/C10 \leq 1.05$.

Also, with the white toner according to the exemplary embodiment, a decrease in color reproducibility of the colored image in a curved state can be suppressed by the mechanism described above. Thus, it is unnecessary to relatively increase the thickness of the white image or relatively increase the amount of the white pigment in the white image. For this reason, the occurrence of a gap between the colored image and the white image can be suppressed, and in this point also, a decrease in color reproducibility of the colored image is supposed to be suppressed.

The formula (1) and formula (2) relating to the white pigment in the white toner particles can be realized by preparing a dispersion of the white pigment particles while removing the corners of the white pigment particles by using a dispersing apparatus with excellent crushing force during production of the white toner particles by an aggregation coalescence method.

When in sectional observation of the white toner particles, the average value of the areas of Voronoi polygons generated by Voronoi division of the white pigment using the centers of gravity of the white pigment as generatrices is Sa ($\mu m^2$), and a standard deviation is Ssd ($\mu m^2$), the white toner according to the exemplary embodiment preferably satisfies the following formula (3) and formula (4).

$$0.150 \leq Sa \leq 0.350 \quad \text{Formula (3):}$$

$$Ssd \leq 0.250 \quad \text{Formula (4):}$$

The numerical value ranges of Sa and Ssd indicate that the white pigment is uniformly dispersed without aggregation in the white toner particles and has a proper distance between the white pigment particles. The white toner satisfying the formula (3) and formula (4) can form the white image which transmits less light, and the colored image in a curved state has more excellent color reproducibility.

The Sa more preferably satisfies the formula (3'): $0.180 \leq Sa \leq 0.300$, and still more preferably satisfies the formula (3"): $0.200 \leq Sa \leq 0.270$.

The Ssd is more preferably 0.200 or less and still more preferably 0.170 or less. The Ssd is preferably as small as possible but is actually 0.100 or more and generally 0.120 or more.

Further, when in a distribution of uneven distribution degrees of the white pigment represented by formula (A) below, the maximum frequent value is Pm and the skewness is Psk, the white toner according to the exemplary embodiment preferably satisfies the following formula (5) and formula (6).

$$\text{Uneven distribution degree} = 2d/D \quad \text{Formula (A):}$$

$$0.78 \leq Pm \leq 0.98 \quad \text{Formula (5):}$$

$$-1.10 \leq Psk \leq -0.60 \quad \text{Formula (6):}$$

In the formula (A), D is the equivalent circle diameter (μm) of the white toner particles, which is determined by sectional observation of the white toner particles, and d is the distance (μm) from the center of gravity of each of the white toner particles to the center of gravity of each of the white pigment particles, which is determined by sectional observation of the white toner particles.

The numerical value ranges of Pm and Psk indicate that the white pigment is well uniformly dispersed with little unevenness from the center of each of the white toner particles to near the surface. The white toner satisfying the formula (5) and formula (6) can form the white image which transmits less light, and the colored image in a curved state has more excellent color reproducibility.

The Pm more preferably satisfies the formula (5'): $0.82 \leq Pm \leq 0.96$, and still more preferably satisfies the formula (5"): $0.85 \leq Pm \leq 0.95$.

The Psk more preferably satisfies the formula (6'): $-0.90 \leq Psk \leq -0.60$, and still more preferably satisfies the formula (6"): $-0.80 \leq Psk \leq -0.75$.

The numeral value ranges of Sa and Ssd and the numerical value ranges of Pm and Psk relating to the white pigment in the white toner particles can be realized by adjusting the BET specific surface area of the white pigment used as a material to be within a proper range and by well uniformly dispersing the toner particles in a solvent during production of the toner particles by an aggregation coalescence method.

[Sectional Observation of White Toner Particles]

Here, a description is made of a method for observing sections of the white toner particles according to the exemplary embodiment and a method for determining each of the physical properties based on the sectional observation.

—Formation of Sample for Observation and Extraction of Sections for Observation—

The toner particles (to which an external additive may adhere) are embedded with a bisphenol A liquid epoxy resin and a curing agent to form a sample for cutting. The cutting sample is cut at −100° C. or less by using a cutting machine (for example, LEICA Ultramicrotome, manufactured by Hitachi High-Technologies Co., Ltd.) provided with a diamond knife to form a sample for observation. If required, the sample for observation is dyed by being allowed to stand in a desiccator under a ruthenium tetraoxide atmosphere.

The resultant sample for observation is observed with a scanning transmission electron microscope (STEM), and a STEM image is recorded at such a magnification that a section of one toner particle comes in a viewing field. The recorded STEM image is analyzed by using an image analysis software (WinROOF 2015 manufactured by Mitani Corporation) under the condition of 0.010000 m/pixel, and the sectional shape of the toner particle is determined from a luminance difference (contrast) between the epoxy resin for embedding and the binder resin of the toner particle.

—Circularity Distribution of White Pigment—

In the STEM image, the white pigment looks black due to the luminance difference (contrast) between the binder resin, a mold release agent, or the like and the white pigment, and thus black particles in the section of a toner particle are the white pigment. The sectional shape of the white pigment (black particles) is determined by image analysis using the image analysis software under the condition of 0.010000 μm/pixel. The areas and peripheral lengths of particle images of the whole white pigment (black particles) present in the region of one toner particle are determined, and circularity (=4π×(area of particle image)÷(peripheral length of particle image)$^2$) is calculated. This is performed for at least 200 toner images, and a circularity distribution is formed by statistical analysis processing in a data section at intervals of 0.001. In the circularity distribution, the cumulative 10% circularity from the smaller side is referred to as C10, and the cumulative 50% circularity from the smaller side is referred to as C50.

—Average Diameter of White Pigment—

The equivalent circle diameter (=2√(area of particle image/π) is calculated from the area of each of the particle images used for determining the circularity distribution of the white pigment, and the calculated values are averaged. The measurement points (that is, the number of samples) is the same as for the circularity distribution.

—Center of gravity of white pigment—

When number of pixels in the region of the white pigment is n, and the xy coordinates of each of the pixels are $x_i$ and $y_i$ (i=1, 2, . . . n), the x coordinate of the center of gravity is (total of $x_i$)/n, and the y coordinate of the center of gravity is (total of $y_i$)/n.

—Equivalent Circle Diameter D of Toner Particle—

The projection area of a toner particle is determined on the basis of the sectional shape, and the equivalent circle diameter (=2√(area/π) is calculated from the area and regarded as the equivalent circle diameter D of the toner particles.

—Center of Gravity of Toner Particle—

When number of pixels in the region of a toner particle is n, and the xy coordinates of each of the pixels are $x_i$ and $y_i$ (i=1, 2, . . . n), the x coordinate of the center of gravity is (total of $x_i$)/n, and the y coordinate of the center of gravity is (total of $y_i$)/n.

—Distance d from Center of Gravity of Toner Particle to Center of Gravity of White Pigment—

The distance d is calculated from the xy coordinates of the center of gravity of a toner particle and the xy coordinates of the center of gravity of the white pigment.

—Average Value Sa and Standard Deviation Ssd of Voronoi Polygon Area—

Voronoi polygon division (zones of nearest proximity of each generatrix are divided by drawing a perpendicular bisector of a straight line which connects adjacent generatrices) is carried out by using as the generatrices the centers of gravity of the whole white pigment present in the region of one toner particle, and the areas of all Voronoi polygons formed are measured. When the viewing field contains a toner particle which is not the observation object and when a black image region causing noise is present near a toner particle as the observation object, the region other than that of a toner particle as the observation object is specified to be excluded in image analysis.

Further, the processing described above is carried out for at least 200 toner particles, and the average value Sa and standard deviation Ssd of the Voronoi polygon areas are calculated.

—Uneven Distribution Degree of White Pigment Represented by Formula (A), Distribution of Uneven Distribution Degrees, Maximum Frequent Value Pm, and Skewness Psk—

The uneven distribution degree of the white pigment (=2d/D) is calculated from the equivalent circle diameter D and the distance d. The uneven distribution degree of the white pigment is calculated for the whole white pigment present in the region of one toner particle. This processing is performed for at least 200 toner particles, and a distribution of uneven distribution degrees is obtained by statistical analysis processing in a data section at intervals of 0.01. The maximum frequent value Pm is a value at a frequency peak in a histogram showing the distribution of uneven distribution degrees. The skewness Psk is calculated by the following formula.

$$Sk = \frac{n}{(n-1)(n-2)} \sum_{i=1}^{n} \left( \frac{x_i - \bar{x}}{s} \right)^3$$

In the formula, Sk is skewness, n is the number of samples, $x_i$ (i=1, 2, . . . , n) of the uneven distribution degree of each sample, x with an upper bar is the average value of the uneven distribution degrees of all samples, and s is the standard deviation of the uneven distribution degrees of all samples.

The configuration of the toner according to the exemplary embodiment is described in detail below.

[White Toner Particle]

The white toner particles contain at least the binder resin and the white pigment, and if required, a mold release agent and other additives.

—Binder Resin—

Examples of the binder resin include vinyl resins composed of homopolymers of monomers or copolymers of combination of two or more of the monomers, such as styrenes (for example, styrene, parachlorostyrene, α-methylstyrene, and the like), (meth)acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, and the like), ethylenically unsaturated nitriles (for example, acrylonitrile, methacrylonitrile, and the like), vinyl ethers (for example, vinyl methyl ether, vinyl isobutyl ether, and the like), vinyl ketones (for example, vinyl methyl ketone, vinyl ethyl ketone, vinyl isopropenyl ketone, and the like), olefins (for example, ethylene, propylene, butadiene, and the like), and the like.

Other examples of the binder resin include non-vinyl resins such as epoxy resins, polyester resins, polyurethane resins, polyamide resin, cellulose resins, polyether resins, modified rosin resins, and the like, a mixture of the non-vinyl resin with the vinyl resin, graft polymers produced by polymerizing vinyl monomers in the coexistence of these, and the like.

These binder resins may be used alone or in combination of two or more.

The binder resin is preferably a polyester resin. The polyester resin is, for example, a condensation polymer of a polyhydric carboxylic acid and a polyhydric alcohol.

Examples of the polyhydric carboxylic acid include aliphatic dicarboxylic acids (for example, oxalic acid, malonic acid, maleic acid, fumaric acid, citraconic acid, itaconic acid, glutaconic acid, succinic acid, alkenylsuccinic acid, adipic acid, sebacic acid, and the like), alicyclic dicarboxylic acids (for example, cyclohexane dicarboxylic acid and the like), aromatic dicarboxylic acids (for example, terephthalic acid, isophthalic acid, phthalic acid, naphthalene dicarboxylic acid, and the like), and anhydrides or lower (for example, 1 or more and 5 or less carbon atoms) alkyl esters thereof. Among these, for example, an aromatic dicarboxylic acid is preferred as the polyhydric carboxylic acid.

A dicarboxylic acid may be used in combination with a tri- or higher-hydric carboxylic acid having a crosslinked structure or branched structure as the polyhydric carboxylic acid. Examples of the tri- or higher-hydric carboxylic acid include trimellitic acid, pyromellitic acid, anhydrides or lower (for example, 1 or more and 5 or less carbon atoms) alkyl esters thereof, and the like.

The polyhydric carboxylic acids may be used alone or in combination of two or more.

Examples of the polyhydric alcohol include aliphatic diols (for example, ethylene glycol, diethylene glycol, triethylene glycol, propylene glycol, butanediol, hexanediol, neopentyl glycol, and the like), alicyclic diols (for example, cyclohexanediol, cyclohexane dimethanol, hydrogenated bisphenol A, and the like), aromatic diols (for example, bisphenol A ethylene oxide adduct, bisphenol A propylene oxide adduct, and the like), and the like. Among these, the polyhydric alcohol is preferably an aromatic diol or alicyclic diol and more preferably an aromatic diol.

The diol may be used in combination with a tri- or higher-hydric alcohol having a crosslinked structure or branched structure as the polyhydric alcohol. Examples of the tri- or higher-hydric alcohol include glycerin, trimethylolpropane, and pentaerythritol.

The polyhydric alcohols may be used alone or in combination of two or more.

The glass transition temperature (Tg) of the polyester resin is preferably 50° C. or more and 80° C. or less and more preferably 50° C. or more and 65° C. or less. The glass transition temperature of the polyester resin can be determined from a DSC curve obtained by differential scanning calorimetry (DSC). More specifically, the glass transition temperature can be determined by "Extrapolation Glass Transition Starting Temperature" described in Determination of Glass Transition Temperature of JIS K7121-1987 "Testing methods for transition temperatures of plastics".

The weight-average molecular weight (Mw) of the polyester resin is preferably 5,000 or more and 1,000,000 or less and more preferably 7,000 or more and 500,000 or less. The number-average molecular weight (Mn) of the polyester resin is preferably 2,000 or more and 100,000 or less. The molecular weight distribution Mw/Mn of the polyester resin is preferably 1.5 or more and 100 or less and more preferably 2 or more and 60 or less.

The weight-average molecular weight and number-average molecular weight of the polyester resin are measured by gel permeation chromatography (GPC). The GPC molecular weight measurement is performed by using GPC•HCL-8120GPC manufactured by Tosoh Corporation as a measurement apparatus, TSK gel Super HM-M (15 cm) manufactured by Tosoh Corporation as a column, and THF as a solvent. The weight-average molecular weight and number-average molecular weight are calculated from the measurement results by using a molecular weight calibration curve formed by using monodisperse polystyrene standard samples.

The polyester resin can be produced by a known production method. Specifically, the polyester resin can be produced by, for example, a method of reaction at a polymerization temperature of 180° C. or more and 230° C. or less, if required, in a reaction system under reduced pressure, while the water and alcohol produced in the condensation is removed.

When a monomer as a raw material is not dissolved or not compatible at the reaction temperature, the monomer may be dissolved by adding a solvent having a high boiling point as a solubilizer. In this case, polycondensation reaction is performed while distilling off the solubilizer. When a monomer with low compatibility is present, the monomer with low compatibility may be previously condensed with an acid or alcohol to be polycondensed with the monomer and then polycondensed with a main component.

The content of the binder resin is preferably 40% by mass or more and 95% by mass or less, more preferably 50% by mass or more 90% by mass or less, and still more preferably 60% by mass or more and 85% by mass or less relative to the whole toner particles.

—White Pigment—

The white pigment is, for example, inorganic oxide particles, and examples thereof include titanium dioxide ($TiO_2$), silicon dioxide ($SiO_2$), alumina ($Al_2O_3$), and the like. These white pigments may be used alone or in combination of two or more.

The white pigment is preferably titanium dioxide from the viewpoint of excellent hiding properties. The crystal structure of titanium dioxide may be any one of an anataze type, a rutile type, and a brookite type.

The white pigment may be a white pigment which is surface-treated according to demand, and may be used in combination with a dispersant.

From the viewpoint of hiding properties, the average diameter of the white pigment is preferably 150 nm or more and 400 nm or less, more preferably 180 nm or more and 380 nm or less, and still more preferably 200 nm or more and 350 nm or less. As described above, the average diameter of the white pigment is determined by observing the sections of the white toner particles.

From the viewpoint of hiding properties of a white image, the BET specific surface area of the white pigment is preferably 6.5 $m^2/g$ or more and 8.5 $m^2/g$ or less, more preferably 6.8 $m^2/g$ or more and 8.2 $m^2/g$ or less, and still more preferably 7.0 $m^2/g$ or more and 8.0 $m^2/g$ or less.

The BET specific surface area of the white pigment is determined by the following measurement method.

When an external additive is externally added to the toner particles, the external additive is separated from the toner particles by suspending the toner particles in water to which a surfactant has been added, applying ultrasonic waves, and then performing centrifugal separation. Then, the toner particles are suspended in a solvent (for example, tetrahydrofuran) to dissolve the binder resin in the solvent. Then, a solid is separated from a liquid by filtration, well washed with water, and then dried to produce a powder (that is, the white pigment). The BET specific surface area of the powder used as a sample is measured by a BET multipoint method using nitrogen gas.

With the white pigment having a BET specific surface area within the range described above, the white image has excellent hiding properties for the following conceivable reason.

When the white pigment used as a material of the toner particles has a BET specific surface area within a proper range, the white pigment is compatible with a surfactant and is easily dispersed in a solvent during production of the toner particles by the aggregation coalescence method. As a result, the white pigment is well uniformly dispersed in the toner particles, and thus the hiding properties of a white image is supposed to be improved. The white pigment used as a material is crushed in preparation of a white pigment particle dispersion liquid, but the white pigment preferably shows a BET specific surface area within the range in the state of being contained in the toner particles.

The content of the white pigment is preferably 15% by mass or more and 45% by mass or less and more preferably 20% by mass or more and 40% by mass or less relative to the whole toner particles.

—Mold Release Agent—

Examples of the mold release agent include natural wax such as hydrocarbon-based wax, carnauba wax, rice bran wax, candelilla wax, and the like; synthetic or mineral-based/petroleum wax such as montan wax and the like; ester-based wax such as fatty acid esters, montanic acid esters, and the like; and the like. The mold release agent is not limited to these.

The melting temperature of the mold release agent is preferably 50° C. or more and 110° C. or less and more preferably 60° C. or more and 100° C. or less. The melting temperature of the mold release agent can be determined from a DSC curve obtained by differential scanning calorimetry (DSC) according to "Melting Peak Temperature" described in Determination of Melting Temperature of JIS K7121-1987 "Testing methods for transition temperatures of plastics".

The content of the mold release agent is preferably 1% by mass or more and 20% by mass or less and more preferably 5% by mass or more and 15% by mass or less relative to the whole toner particles.

—Other Additives—

Examples of other additives include known additives such as a magnetic material, a charge control agent, an inorganic powder, and the like. These additives are contained as internal additives in the toner particles.

[Characteristics of Toner Particle]

The toner particles may be toner particles with a single-layer structure or toner particles with a so-called core-shell structure configurated by a core part (core particle) and a coating layer (shell layer) which coats the core part. The toner particles with a core-shell structure are configurated by, for example, a core part containing a binder resin and, if required, a coloring agent, a mold release agent, etc., and a coating layer containing the binder resin.

The volume-average particle diameter (D50v) of the toner particles is preferably 2 μm or more and 10 μm or less and more preferably 4 μm or more and 9 μm or less.

The volume-average particle diameter of the toner particles is measured by using Coulter Multisizer II (manufactured by Beckman Coulter Inc.) and an electrolytic solution ISOTON-II (manufactured by Beckman Coulter Inc.). In the measurement, 0.5 mg or more and 50 mg or less of a measurement sample is added to 2 ml of a 5 mass % aqueous solution of a surfactant (preferably sodium alkylbenzene sulfonate), and the resultant mixture is added to 100 ml or more and 150 ml or less of the electrolytic solution. The electrolytic solution in which the sample has been suspended is dispersed for 1 minute by using an ultrasonic disperser, and the particle diameters of particles having a particle diameter within a range of 2 μm or more and 60 μm or less are measured by using Coulter Multisizer II and an aperture having an aperture diameter of 100 μm. The number of particles sampled is 50,000. In a volume-based particle size distribution of the measured particle diameters, the cumulative 50% particle diameter from the smaller diameter side is regarded as the volume-average particle diameter D50v.

The average circularity of the toner particles is preferably 0.94 or more and 1.00 or less and more preferably 0.95 or more and 0.98 or less.

The average circularity of the toner particles is determined by (equivalent circle circumference length)/(circumference length) [(circumference length of a circle having the same projection area as a particle image)/(circumference length of particle projection image)]. Specifically, the average circularity is a value measured by the following method.

First, the toner particles used as a measurement object are collected by suction to form a flat flow, a particle image is captured as a still image by instantaneous strobe light emission, and the average circularity is determined by image analysis of the particle image using a flow particle image analyzer (FPIA-3000 manufactured by Sysmex Corporation). The number of particles sampled for determining the average circularity is 3500.

When the toner contains an external additive, the toner (developer) as a measurement object is dispersed in water containing a surfactant, and then the external additive is removed by ultrasonic treatment to produce the toner particles.

[External Additive]

The external additive is, for example, inorganic particles. Examples of the inorganic particles include particles of $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and the like.

The surfaces of inorganic particles used as the external additive may be hydrophobically treated. The inorganic particles are hydrophobically treated by, for example, dipping in a hydrophobic treatment agent. Examples of the hydrophobic treatment agent include, but are not limited to, a silane coupling agent, silicone oil, titanate-based coupling agent, an aluminum-based coupling agent, and the like. These may be used alone or in combination of two or more. The amount of the hydrophobic treatment agent is generally 1 parts by mass or more and 10 parts by mass or less relative to 100 parts by mass of inorganic particles.

Other examples of the external additive include resin particles (for example, resin particles of polystyrene, polymethyl methacrylate, melamine resin, and the like), cleaning activators (for example, a higher fatty acid metal salt such as zinc stearate, and fluorine-based high-molecular-weight material particles), and the like.

In the exemplary embodiment, inorganic oxide particles are preferred as the external additive, and specifically, particles of any one of titanium dioxide ($TiO_2$), silicon dioxide ($SiO_2$), and alumina ($Al_2O_3$) are preferred.

The inorganic oxide particles as the external additive preferably have a spindle shape from the viewpoint that the inorganic oxide particles are hardly buried in the toner particles. The value (long diameter/short diameter) obtained by dividing the long diameter by the short diameter is preferably 2.5 or more and 7.0 or less, more preferably 3.0 or more and 6.5 or less and still more preferably 3.5 or more and 6.0 or less.

The value (long diameter/short diameter) of the spindle-shaped inorganic oxide particles is determined by the following measurement method.

The toner to which the inorganic oxide particles have been added is observed with a scanning electron microscope (SEM), and at least 200 particles which look to have a spindle shape are extracted from the particles adhering to the peripheries of toner particles. The longest line among the straight lines drawn between any desired two points on the contour line of a spindle-shaped particle is regarded as a long axis, and the length of the long axis is regarded as the long diameter. In addition, the longest line among straight lines perpendicular to the long axis and drawn inside the contour line of the spindle-shaped particle is regarded as a short axis, and the length of the short axis is regarded as the short diameter. The long diameter, short diameter, and the value (long diameter/short diameter) of each of the spindle-shaped particles are determined, and the values of at least 200 particles is averaged.

The amount of the external additive externally added is preferably 1 part by mass or more and 6 parts by mass or less and more preferably 1 part by mass or more and 4 parts by mass or less relative to 100 parts by mass of the toner particles.

[Method for Producing Toner]

Next, a method for producing the toner according to the exemplary embodiment is described.

The toner according to the exemplary embodiment is produced by producing the toner particles and then externally adding the external additive to the toner particles.

The toner particles may be produced by a dry method (for example, a kneading-grinding method or the like) or a wet method (for example, an aggregation coalescence method, a suspension polymerization method, a dissolution suspension method, or the like). These methods are not particularly limited, and a known method is used. Among these, the aggregation coalescence method is preferred for producing the toner particles.

Specifically, for example, when the toner particles are produced by the aggregation coalescence method, the toner particles are produced as follows.

A resin particle dispersion in which resin particles used as the binder resin are dispersed is prepared (preparation of a resin particle dispersion). The resin particles (if required, other particles) are aggregated in the resin particle dispersion (if required, a dispersion mixture with another particle dispersion) to form aggregated particles (formation of aggregated particles). The aggregated particles are fused and coalesced by heating the aggregated particle dispersion in which the aggregated particles are dispersed, thereby forming the toner particles (fusion/coalescence).

The aggregation coalescence method is described in detail below. In the description below, the method for producing the toner particles containing the mold release agent is described, but the mold release agent is used according to demand. Of course, other additives other than the mold release agent may be used.

—Preparation of Resin Particle Dispersion—

In addition to the resin particle dispersion in which the resin particles used as the binder resin are dispersed, a white pigment particle dispersion in which the white pigment is dispersed, and a mold release agent particle dispersion in which the mold release agent particles are dispersed are prepared.

The resin particle dispersion is prepared by, for example, dispersing the resin particles in a dispersion medium with a surfactant.

The dispersion medium used in the resin particle dispersion is, for example, an aqueous medium.

Examples of the aqueous medium include water such as distilled water, ion exchange water, and the like, alcohols, and the like. These may be used alone or in combination of two or more.

Examples of the surfactant include sulfate ester salt-based, sulfonic acid salt-based, phosphate ester-based, and soap-based anionic surfactants and the like: amine salt-type and quaternary ammonium salt-type cationic surfactants and the like; polyethylene glycol-based, alkylphenol ethylene oxide adduct-based, and polyhydric alcohol-based nonionic surfactants and the like; and the like. Among these, an anionic surfactant or cationic surfactant is particularly used. A nonionic surfactant may be used in combination with the anionic surfactant or cationic surfactant.

These surfactants may be used alone or in combination of two or more.

A method for dispersing the resin particles in the dispersion medium is, for example, a general dispersion method using a rotary-shear homogenizer, a ball mill having media, a sand mill, a dyno mill, or the like. The resin particles may be dispersed in the dispersion medium by a phase inversion emulsion method according to the type of the resin particles. The phase inversion emulsion method is a method including dissolving a resin to be dispersed in a hydrophobic organic solvent which can dissolve the resin, neutralizing an organic continuous phase (O phase) by adding a base thereto, and then performing phase inversion from W/O to O/W by pouring into water (W phase), thereby dispersing the resin in the form of particles in the aqueous medium.

The volume-average particle diameter of the resin particles dispersed in the resin particle dispersion is, for example, preferably 0.01 μm or more 1 μm or less, more preferably 0.08 μm or more and 0.8 μm or less, and still more preferably 0.1 μm or more and 0.6 μm or less.

The volume-average particle diameter of the resin particles is determined by using a particle size distribution obtained by measurement using a laser diffraction particle size distribution analyzer (for example, LA-700 manufactured by HORIBA, Ltd.). A volume-based cumulative distribution is formed from the smaller particle diameter side for the divided particle size ranges (channels), and the particle diameter at 50% of the volume of the whole particles is regarded as the volume-average particle diameter D50v. The volume-average particle diameter of particles in any one of the other dispersions is measured by the same method.

The content of the resin particles contained in the resin particle dispersion is preferably 5% by mass or more and 50% by mass or less and more preferably 10% by mass or more and 40% by mass or less.

The mold release agent particle dispersion is prepared by the same method as for the resin particle dispersion. That is, the dispersion medium, dispersion method, volume-average particle diameter, and content of the particles in the resin particle dispersion are true for the mold release agent particle dispersion.

The white pigment particle dispersion is prepared by the same method as for the resin particle dispersion. In preparing the white pigment particle dispersion, the white pigment particle dispersion is preferably prepared while removing the corners of white pigment particles by using a dispersing apparatus having excellent crushing force.

The volume-average particle diameter (measured by a laser diffraction particle size distribution analyzer) of the white pigment particles dispersed in the white pigment particle dispersion is preferably 200 nm or more and 900 nm or less, more preferably 250 nm or more and 800 nm or less, and still more preferably 300 nm or more and 700 nm or less.

The content of the white pigment particles contained in the white pigment particle dispersion is preferably 5% by mass or more and 50% by mass or less and more preferably 10% by mass or more and 40% by mass or less.

—Formation of Aggregated Particles—

Next, the resin particle dispersion, the white pigment particle dispersion, and the mold release agent particle dispersion are mixed. Then, the resin particles, the white pigment particles, and the mold release agent particles are hetero-aggregated in the resultant mixed dispersion to form the aggregated particles having a diameter close to the diameter of the intended toner particles.

Specifically, an aggregating agent is added to the mixed dispersion and, at the same time, pH of the mixed dispersion is adjusted to an acidic value (for example, pH 2 or more and 5 or less) and, if required, a dispersion stabilizer is added. Then, the particles dispersed in the mixed dispersion are aggregated by heating the resultant mixture to a temperature (specifically, for example, (glass transition temperature of resin particles −30° C.) or more and (glass transition temperature of resin particles −10° C.) or less, which is close to the glass transition temperature of the resin particles, thereby forming the aggregated particles.

In forming the aggregated particles, an aggregating agent may be added at room temperature (for example, 25° C.) under stirring of the mixed dispersion by using a rotary shear homogenizer, then pH of the mixed dispersion may be adjusted to an acidic value (for example, pH 2 or more and 5 or less), and, if required, a dispersion stabilizer may be added before heating.

Examples of the aggregating agent include a surfactant with the polarity opposite to that of the surfactant contained in the mixed dispersion, inorganic metal salts, and di- or higher-valent metal complexes. When a metal complex is used as the aggregating agent, the amount of the aggregating agent used is decreased, and charging characteristics are improved.

The aggregating agent may be used in combination with an additive which forms a complex or similar bond with the metal ion of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, aluminum sulfate, and the like; inorganic metal salt polymers such as aluminum polychloride, aluminum polyhydroxide, calcium polysulfide, and the like.

The chelating agent used may be a water-soluble chelating agent. Examples of the chelating agent include oxycarboxylic acids such as tartaric acid, citric acid, gluconic acid, and the like; aminocarboxylic acids such as imino-diacetic acid (IDA), nitrilotriacetic acid (NTA), ethylenediaminetetraacetic acid (EDTA), and the like; and the like.

The amount of the chelating agent added is, for example, preferably 0.01 parts by mass or more and 5.0 parts by mass or less and more preferably 0.1 parts by mass or more and 3.0 parts by mass or less relative to 100 parts by mass of the resin particles.

—Fusion-Coalescence—

Next, the aggregated particles are fused and coalesced by heating the aggregated particle dispersion in which the aggregated particles are dispersed to, for example, a temperature equal to or higher than the glass transition temperature of the resin particles (for example, 10° C. to 30° C. higher than the glass transition temperature of the resin particles), thereby forming the toner particles.

The toner particles are produced through the process described above.

The toner particles may be produced as follows. After the preparation of the aggregated particle dispersion in which the aggregated particles are dispersed, the aggregated particle dispersion is further mixed with the resin particle dispersion in which the resin particles are dispersed, and second aggregated particles are formed by aggregation so that the resin particles further adhere to the surfaces of the aggregated particles. Then, the second aggregated particles are fused and coalesced by heating the second aggregated particle dispersion, in which the second aggregated particles are dispersed, to form toner particles with a core-shell structure.

After fusion-coalescence is completed, dry toner particles are produced by a known method of washing, solid-liquid separation, and drying of the toner particles formed in the solution. The washing is preferably performed by sufficient displacement washing with ion exchange water from the viewpoint of chargeability. The solid-liquid separation is preferably performed by suction filtration, pressure filtration, or the like from the viewpoint of productivity. The drying is preferably performed by freeze drying, flash drying, fluidized drying, vibration-type fluidized drying, or the like from the viewpoint of productivity.

The toner according to the exemplary embodiment of the present invention is produced by, for example, adding and mixing the external additive with the dry toner particles. Mixing may be performed by, for example, a V blender, a HENSCHEL MIXER, a Loedige mixer, or the like. Further, if required, coarse toner particles may be removed by using a vibrating sieve machine, an air sieve machine, or the like.

<Electrostatic Image Developer>

An electrostatic image developer according to an exemplary embodiment of the present invention contains at least the white toner according to the exemplary embodiment of the present invention. The electrostatic image developer according to the exemplary embodiment may be a one-component developer containing only the white toner according to the exemplary embodiment or a two-component developer including a mixture of the toner and a carrier.

The carrier is not particularly limited, and a known carrier can be used. Examples of the carrier include a coated carrier which contains a core material including a magnetic powder and having a resin-coated surface; a magnetic powder-dispersed carrier which contains a magnetic powder mixed and dispersed in a matrix resin; a resin-impregnated carrier which contains a porous magnetic powder impregnated with a resin; and the like. The magnetic powder-dispersed carrier and the resin-impregnated carrier may be a carrier which contains the constituent particles of the carrier as a core material and a coating resin on the surface of the core material.

Examples of the magnetic powder include powders of magnetic metals such as iron, nickel, cobalt, and the like; magnetic oxides such as ferrite, magnetite, and the like; and the like.

Examples of the coating resin and matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylic acid ester copolymer, a straight silicone resin containing an organosiloxane bond or modified products thereof, a fluorocarbon resin, polyester, polycarbonate, a phenol resin, an epoxy resin, and the like. The coating resin and matrix resin may contain additives such as conductive particles and the like. Examples of the conductive particles include particles of metals such as gold, silver, copper, and the like, carbon black, titanium dioxide, zinc oxide, tin oxide, barium sulfate, aluminum borate, potassium titanate, and the like.

The surface of the core material can be coated with the resin by, for example, a method of coating with a solution for forming a coating layer, which is prepared by dissolving the coating resin and various additives (used according to demand) in a proper solvent. The solvent is not particularly limited and may be selected in view of the type of the resin used, coatability, etc. Examples of a resin coating method include a dipping method of dipping the core material in the solution for forming a coating layer; a spray method of spraying the solution for forming a coating layer on the surface of the core material; a fluidized bed method of spraying the solution for forming a coating layer on the core material in a state of being floated by fluidized air; a kneader/coater method of mixing the core material of the carrier with the solution for forming a coating layer in a kneader/coater and then removing the solvent; and the like.

The mixing ratio (mass ratio) of the toner to the carrier in the two-component developer is preferably toner:carrier=1:100 to 30:100 and more preferably 3:100 to 20:100.

<Image Forming Apparatus and Image Forming Method>

An image forming apparatus and image forming method according an exemplary embodiment of the present invention are described.

The image forming apparatus according the exemplary embodiment includes an image holding member, a charging unit which charges the surface of the image holding member, an electrostatic image forming unit which forms an electrostatic image on the charged surface of the image holding member, a developing unit which houses an electrostatic image developer and develops, as a toner image, the electrostatic image formed on the surface of the image holding member with the electrostatic image developer, a transfer unit which transfers the toner image formed on the surface of the image holding member to the surface of a recording medium, and a fixing unit which fixes the toner image transferred to the surface of the recording medium. The electrostatic image developer according to the exemplary embodiment is used as the electrostatic image developer.

The image forming apparatus according the exemplary embodiment performs an image forming method (the image forming method according to the exemplary embodiment) which includes charging the surface of the image holding member, forming an electrostatic image on the charged surface of the image holding member, developing as a toner image the electrostatic image formed on the surface of the image holding member with the electrostatic image developer according to the exemplary embodiment, transferring the toner image formed on the surface of the image holding member to the surface of a recording medium, and fixing the toner image transferred to the surface of the recording medium.

Examples of application of the image forming apparatus according to the exemplary embodiment include known image forming apparatuses such as an apparatus of a direct transfer system in which a toner image formed on the surface of an image holding member is transferred directly to a recording medium; an apparatus of an intermediate transfer system in which a toner image formed on the surface of an image holding member is first transferred to the surface of an intermediate transfer body and the toner image transferred to the surface of the intermediate transfer body is second transferred to the surface of a recording medium; an apparatus including a cleaning unit which cleans the surface of an image holding member before charging; an apparatus including an eliminating unit which eliminates electricity by applying eliminating light to the surface of an image holding member before charging; and the like.

When the image forming apparatus according to the exemplary embodiment is an apparatus of the intermediate transfer system, a configuration applied to the transfer unit includes, for example, an intermediate transfer body to the surface of which a toner image is transferred, a first transfer unit which first transfers the toner image formed on the surface of the image holding member to the intermediate transfer body, and a second transfer unit which second transfers the toner image transferred to the surface of the intermediate transfer body to the surface of the recording medium.

In the image forming apparatus according to the exemplary embodiment, for example, a part containing the developing unit may be a cartridge structure (process cartridge) detachable from the image forming apparatus. An example which is preferably used as the process cartridge is a process cartridge including the developing unit which houses the electrostatic image developer according to the exemplar embodiment.

The image forming apparatus according to the exemplary embodiment may be an image forming apparatus of a tandem system in which an image forming unit that forms a white toner image and at least one image forming unit that forms a colored toner image are arranged in parallel, or a monochrome image forming apparatus which forms only a white image. In the latter case, a white image is formed on a recording medium by the image forming apparatus according to the exemplary embodiment, and a colored image is formed on the recording medium by another image forming apparatus.

The recording medium on which an image is formed by the image forming apparatus (image forming method) according to the exemplary embodiment is not particularly limited, and a known recording medium is applied. Examples thereof include a resin film or sheet, paper, and the like. Examples of application of the resin film or sheet include a package, a label, a packing material, an advertising medium, an OHP sheet, and the like.

Examples of the resin film or sheet include polyolefin films or sheets of polyethylene, polypropylene, and the like; polyester films or sheets of polyethylene terephthalate, polybutylene terephthalate, and the like; polyamide films or sheets of nylon and the like; films or sheets of polycarbonate, polystyrene, modified polystyrene, polyvinyl chloride, polyvinyl alcohol, polylactic acid, and the like; and the like. These films or sheets may be unstretched films or sheets or uniaxially or biaxially stretched films or sheets. The resin film or sheet may have a single-layer or multilayer form. The resin film or sheet may be a film having a surface coating layer which assists fixing of toner, or a film or sheet treated by corona treatment, ozone treatment, plasma treatment, flame treatment, glow discharge treatment, or the like.

Examples of the lamination order of the recoding medium, the colored image, and the white image (hiding layer) include the following (a), (b), and (c).

Lamination order (a): the recording medium having transparency/the colored image/the white image (hiding layer) from the side near the viewer.

Lamination order (b): the colored image/the recording medium having transparency/the white image (hiding layer) from the side near the viewer.

Lamination order (c): the colored image/the white image (hiding layer)/the recording medium (regardless of with or without transparency) from the side near the viewer.

An example of the image forming apparatus according to the exemplary embodiment is described below, but the image forming apparatus is not limited to this example. In the description below, principal parts shown in the drawings are described, and other parts are not described.

FIG. 1 is a schematic configuration diagram showing the image forming apparatus according to the exemplary embodiment, which is an image forming apparatus of a quintuple-tandem intermediate transfer system. The image forming apparatus shown in FIG. 1 (that is, the image forming apparatus of an intermediate transfer system in which image forming units 10W, 10K, 10C, 10M, and 10Y are arranged in the order shown in in FIG. 1) is used in application in which images are formed in the lamination order (a) on the recording medium having transparency.

The image forming apparatus shown in FIG. 1 includes the first to fifth image forming units 10W, 10K, 10C, 10M, and 10Y (image forming units) of an electrophotographic system which output images of the colors of white (W), black (K), cyan (C), magenta (M), yellow (Y) based on color-separated image data. The image forming units (may be simply referred to as the "units" hereinafter) 10W, 10K, 10C, 10M, and 10Y are arranged in parallel at predetermined spaces in the horizontal direction. These units 10W, 10K, 10C, 10M, and 10Y may be process cartridges detachable from the image forming apparatus.

In addition, an intermediate transfer belt (an example of the intermediate transfer body) 20 is extended below the units 10W, 10K, 10C, 10M, and 10Y so as to pass through the units. The intermediate transfer belt 20 is provided to be wound on a drive roller 22, a support roller 23, and a counter roller 24, which are disposed in contact with the inner surface of the intermediate transfer belt 20, so that the intermediate transfer belt 20 moves in the direction from the first unit 10W to the fifth unit 10Y. Further, an intermediate transfer body cleaning device 21 is provided on the image holding surface side of the intermediate transfer belt 20 so as to face the drive roller 22.

In addition, the white, black, cyan, magenta, yellow toners contained in toner cartridges 8W, 8K, 8C, 8M, and 8Y are supplied to developing devices (an example of the developing unit) 4W, 4K, 4C, 4M and 4Y of the units 10W, 10K, 10C, 10M, and 10Y, respectively.

The first to fifth units 10W, 10K, 10C, 10M, and 10Y have the same configuration and operation and thus the first unit 10W which forms a white image and disposed on the upstream side in the movement direction of the intermediate transfer belt is described as a representative.

The first unit 10W has a photoreceptor 1W functioning as the image holding member. Around the photoreceptor 1W, there are sequentially provided a charging roller (an example of the charging unit) 2W which charges the surface of the photoreceptor 1W to a predetermined potential, an exposure device (an example of the electrostatic image forming unit) 3W which forms an electrostatic image by exposure of the charged surface with a laser beam based on an image signal obtained by color separation, a developing device (an example of the developing unit) 4W which develops the electrostatic image by supplying the toner to the electrostatic image, a first transfer roller (an example of the first transfer body) 5W which transfers the developed toner image to the intermediate transfer belt 20, and a photoreceptor cleaning device (an example of the cleaning unit) 6W which removes the toner remaining on the surface of the photoreceptor 1W after first transfer.

The first transfer roller SW is disposed on the inside of the intermediate transfer belt 20 and is provided at a position facing the photoreceptor 1W. Further, a bias power supply (not shown) is connected to each of the first transfer rollers 5W, 5K, 5C, 5M, and 5Y of the respective units in order to apply a first transfer bias thereto. The value of transfer bias applied to each of the first transfer rollers from the bias power supply can be changed by control of a controller (not shown).

The operation of forming a white image in the first unit 10W is described below.

First, before the operation, the surface of the photoreceptor 1W is charged to a potential of −600 V to −800 V by the charging roller 2W.

The photoreceptor 1W is formed by laminating a photosensitive layer on a conductive (for example, a volume resistivity of $1\times10^{-6}$ Ω·cm or less) substrate. The photosensitive layer generally has high resistance (the resistance of a general resin) and has the property that when irradiated with a laser beam, the resistivity of a portion irradiated with the laser beam is changed. Thus, the charged surface of the photoreceptor 1W is irradiated with a laser beam from the exposure device 3W according to white image data sent from the controller (not shown).

Therefore, an electrostatic image in a white image pattern is formed on the surface of the photoreceptor 1W.

The electrostatic image is an image formed on the surface of the photoreceptor 1W by charging and is a so-called negative latent image formed by the laser beam from the exposure device 3W, which causes the electrostatic charge flowing in the surface of the photoreceptor 1W due to a decrease in resistivity of the irradiated portion of the photosensitive layer while the charge in a portion not irradiated with the laser beam remains.

The electrostatic image formed on the photoreceptor 1W is rotated to a predetermined development position with travel of the photoreceptor 1W. Then, at the development position, the electrostatic image on the photoreceptor 1W is visualized as a toner image by the developing device 4W.

For example, the electrostatic image developer containing at least the white toner and the carrier is housed in the developing device 4W. The white toner is frictionally charged by stirring in the developing device 4W and thus has a charge with the same polarity (negative polarity) as that of the electrostatic charge on the photoreceptor 1W and is held on the developer roller (an example of the developer holding body). When the surface of the photoreceptor 1W is passed through the developing device 4W, the white toner electrostatically adheres to an electrostatically eliminated electrostatic image on the surface of the photoreceptor 1W, developing the electrostatic image with the white toner. Then, the photoreceptor 1W on which the white toner image has been formed is continuously traveled at a predetermined speed, and the toner image developed on the photoreceptor 1W is conveyed to a predetermined first transfer position.

When the white toner image on the photoreceptor 1W is conveyed to the first transfer position, the first transfer bias is applied to the first transfer roller 5W, and electrostatic force to the first transfer roller 5W from the photoreceptor 1W is applied to the toner image. Thus, the toner image on the photoreceptor 1W is transferred to the intermediate transfer belt 20. The transfer bias applied has a polarity (+)

opposite to the polarity (−) of the toner and is controlled in the unit 10W to, for example, +10 μA by the controller (not shown).

On the other hand, the toner remaining on the photoreceptor 1W is removed by the photoreceptor cleaning device 6W and recovered.

The first transfer bias applied to each of the first transfer rollers 5K, 5C, 5M, and 5Y of the second unit 10K and the later units is controlled according to the first unit 10W.

Then, the intermediate transfer belt 20 to which the white toner image has been transferred in the first unit 10W is sequentially conveyed through the second to fifth units 10K, 10C, 10M, and 10Y to superpose the toner images of the respective colors by multi-layer transfer.

The intermediate transfer belt 20 to which the five color toner images have been transferred in multiple layers through the first to fifth units is reached to a second transfer part configurated by the intermediate transfer belt 20, the counter roller 24 in contact with the inner side of the intermediate transfer belt 20, and the second transfer roller (an example of the second transfer unit) 26 disposed on the image holding surface side of the intermediate transfer belt 20. Meanwhile, the recording paper (an example of the recording medium) P is fed with predetermined timing, through a feeding mechanism, to a space in which the second transfer roller 26 is in contact with the intermediate transfer belt 20, and a second transfer bias is applied to the counter roll 24. The applied transfer bias has the same polarity (−) as the polarity (−) of the toner and electrostatic force acting toward the resin sheet P (an example of the recording medium) from the intermediate transfer belt 20 is applied to the toner image to transfer the toner image on the intermediate transfer belt 20 to the resin sheet P. During the second transfer, the second transfer bias is determined according to the resistance detected by a resistance detecting unit (not shown) which detects the resistance of the second transfer part and is voltage-controlled.

Then, the resin sheet P is transported to a pressure-contact part (nip part) of a pair of fixing rollers in the fixing device (an example of the fixing unit) 28, and the toner image is fixed to the resin sheet P, forming a fixed image.

The resin sheet P after the completion of fixing of the color image is discharged to a discharge part, and a series of color image forming operations is finished.

<Process Cartridge/Toner Cartridge>

A process cartridge according to an exemplary embodiment of the present invention is described.

The process cartridge according to the exemplary embodiment is a process cartridge detachably mounted on the image forming apparatus and including a developing unit which houses the electrostatic image developer according to the exemplary embodiment and develops as the toner image the electrostatic image formed on the image holding member.

The process cartridge according to the exemplary embodiment may have a configuration including a developing unit and, if required, for example, at least one selected from other units such as an image holding member, a charging unit, an electrostatic image forming unit, and a transfer unit, etc.

An example of the process cartridge according to the exemplary embodiment is described below, but the process cartridge is not limited to this example. In the description below, principal parts shown in the drawings are described, but description of other parts is omitted.

Figure 2:
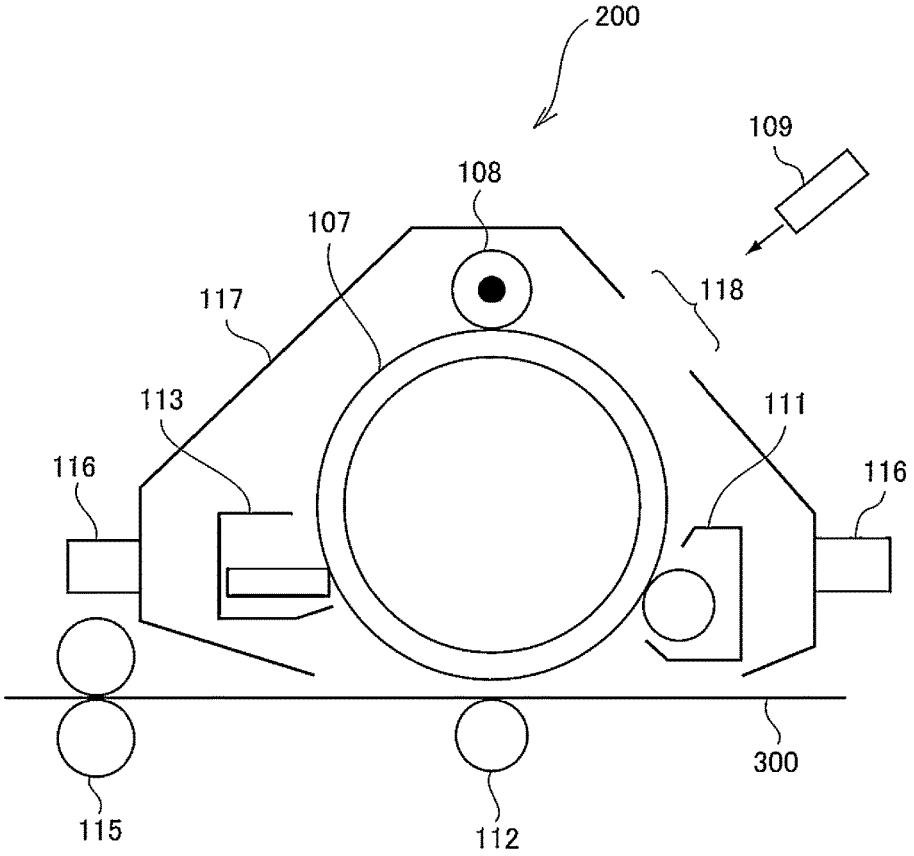
FIG. 2 is a schematic configuration diagram showing an example of a process cartridge according to an exemplary embodiment of the present invention.

FIG. 2 is a schematic configuration diagram showing the process cartridge according to the exemplary embodiment.

A process cartridge 200 shown in FIG. 2 is a cartridge with a configuration in which a photoreceptor 107 (an example of the image holding member) and a charging roller 108 (an example of the charging unit), a developing device 111 (an example of the development unit), and a photoreceptor cleaning device 113 (an example of the cleaning unit), which are provided around the photoreceptor 107, are integrally held in combination by a housing 117 provided with a mounting rail 116 and an opening 118 for exposure.

In FIG. 2, reference numeral 109 denotes an exposure device (an example of the electrostatic image forming unit), reference numeral 112 denotes a transfer device (an example of the transfer unit), reference numeral 115 denotes a fixing device (an example of the fixing unit), and reference numeral 300 denotes a resin sheet (an example of the recording medium).

Next, a toner cartridge according to an exemplary embodiment of the present invention is described.

The toner cartridge according to the exemplary embodiment is a toner cartridge containing the white toner according to the exemplary embodiment and detachable from the image forming apparatus. The toner cartridge is intended to contain the toner for replenishment to supply the toner to the developing unit provided in the image forming apparatus.

The image forming apparatus shown in FIG. 1 is an image forming apparatus having a configuration in which toner cartridges 8W, 8K, 8C, 8M, and 8Y are detachably provided. Each of the developing units 4W, 4K, 4C, 4M, and 4Y is connected to the toner cartridge of the corresponding color through a toner supply tube (not shown). Also, when the amount of the toner contained in the toner cartridge is decreased, the toner cartridge is exchanged. An example of the toner cartridge according to the exemplary embodiment is the toner cartridge 8W and houses the white toner according to the exemplary embodiment. The black, cyan, magenta, and yellow toners are housed in the toner cartridges 8K, 8C, 8M, and 8Y, respectively.

EXAMPLES

Exemplary embodiments of the present invention are described in further detail below by giving examples, but the exemplary embodiments are not limited to these examples. In the description below, "parts" and "%" are on a mass basis unless particularly specified.

<Preparation of Particle Dispersion and the Like>

[Preparation of White Pigment Particle Dispersion (1)]

Titanium dioxide particles (manufactured by Titan Kogyo, Ltd., Product No. KR-380): 100 parts Anionic surfactant (Neogen R, manufactured by Daiichi Kogyo Seiyaku Co., Ltd.): 10 parts Ion exchange water: 150 parts These materials are mixed in a 1000-ml Aiboy wide-mouthed bottle (manufactured by As One Corporation, polypropylene), and 300 parts of zirconia beads having a diameter of 3 mm is added to the resultant mixture. After rotation at 300 rpm for 24 hours by using a ball mill rotating table (manufactured by Asahi Rika Co., Ltd.), the beads are removed from the resultant dispersion by using a stainless sieve, and then ion exchange water is added to prepare a white pigment particle dispersion (1) with a sold content of 40%. As a result of measurement by a laser diffraction particle size distribution analyzer, the volume-average particle diameter of particles in the white pigment particle dispersion (1) is 500 nm.

[Preparation of White Pigment Particle Dispersion (2)]

A white pigment particle dispersion (2) is prepared by the same method as for the white pigment particle dispersion (1) except that the diameter of the zirconia beads is changed to 5 mm.

[Preparation of White Pigment Particle Dispersion (3)]

A white pigment particle dispersion (3) is prepared by the same method as for the white pigment particle dispersion (1) except that the diameter of the zirconia beads is changed to 1 mm.

[Preparation of White Pigment Particle Dispersion (4)]

A white pigment particle dispersion (4) is prepared by the same method as for the white pigment particle dispersion (1) except that the diameter of the zirconia beads is changed to 1 mm, and the rotating treatment time is changed to 72 hours.

[Preparation of White Pigment Particle Dispersion (5)]

A white pigment particle dispersion (5) is prepared by the same method as for the white pigment particle dispersion (1) except that the rotating treatment time is changed to 12 hours.

[Preparation of White Pigment Particle Dispersion (6)]

A white pigment particle dispersion (6) is prepared by the same method as for the white pigment particle dispersion (1) except that the rotating treatment time is changed to 8 hours.

[Preparation of White Pigment Particle Dispersion (7)]

A white pigment particle dispersion (7) is prepared by the same method as for the white pigment particle dispersion (1) except that the amount of the anionic surfactant is changed to 15 parts.

[Preparation of White Pigment Particle Dispersion (8)]

A white pigment particle dispersion (8) is prepared by the same method as for the white pigment particle dispersion (1) except that the amount of the anionic surfactant is changed to 5 parts.

[Preparation of White Pigment Particle Dispersion (9)]

Titanium dioxide particles (manufactured by Titan Kogyo, Ltd., Product No. KR-380): 100 parts Anionic surfactant (Neogen R, manufactured by Daiichi Kogyo Seiyaku Co., Ltd.): 10 parts Ion exchange water: 150 parts These materials are mixed and dispersed for about 10 hours by using a high-pressure collision-type disperser Ultimaizer (HJP 30006, manufactured by Sugino Machine Ltd.), and then ion exchange water is added to prepare a white pigment particle dispersion (9) with a sold content of 40%.

[Preparation of White Pigment Particle Dispersion (10)]

A white pigment particle dispersion (10) is prepared by the same method as for the white pigment particle dispersion (1) except that titanium dioxide particles are changed to Product No. JR-603 manufactured by Tayca Corporation, and the diameter of the zirconia beads is changed to 5 mm.

[Preparation of Polyester Resin Particle Dispersion (1)]

In a two-neck flask dried by heating, 74 parts of dimethyl adipate, 192 parts of dimethyl terephthalate, 216 parts of bisphenol A ethylene oxide adduct, 38 parts of ethylene glycol, and 0.037 parts of tetrabutoxy titanate used as a catalyst are placed and heated under stirring while an inert atmosphere is maintained by introducing nitrogen gas into the flask, followed by co-condensation polymerization reaction at 160° C. for about 7 hours. Then, the temperature is increased to 220° C. while the pressure is gradually decreased to 10 Torr, and then maintained for 4 hours. The pressure is once returned to normal pressure (atmospheric pressure, the same is applied below), and 9 parts of trimellitic anhydride is added. Then, the pressure is again gradually decreased to 10 Torr, and the resultant mixture is maintained for 1 hour to synthesize a polyester resin. The polyester resin has a glass transition temperature of 60 C, a weight-average molecular weight of 12,000, and an acid value of 25.0 mgKOH/g.

Then, 115 parts of the polyester resin, 180 parts of ion exchange water, and 5 parts of the anionic surfactant (Neogen R, manufactured by Daiichi Kogyo Seiyaku Co., Ltd.) are mixed, and the resultant mixture is heated to 120° C. and then sufficiently dispersed by a homogenizer (Ultra-Turrax T50, manufactured by IKA Corporation). Then, the mixture is dispersed for 1 hour by a pressure discharge-type homogenizer (Gorlin homogenizer manufactured by Gorlin Co., Ltd.), and ion exchange water is added to prepare a polyester resin particle dispersion (1) with a solid content of 20%. The volume-average particle diameter of resin particles in the polyester resin particle dispersion (1) is 130 nm.

[Preparation of Mold Release Agent Particle Dispersion (1)]

Paraffin wax (HNP9 manufactured by Nippon Seiro Co., Ltd., melting temperature 72° C.): 90 parts Anionic surfactant (Neogen R, manufactured by Daiichi Kogyo Seiyaku Co., Ltd.): 3.6 parts Ion exchange water: 360 parts These materials are mixed and heated to 100° C. to melt the wax, and the mixture is dispersed at a dispersion pressure of 5 MPa for 2 hours and then at a dispersion pressure of 40 MPa for 3 hours by a pressure discharge-type homogenizer (Gorlin homogenizer manufactured by Gorlin Co., Ltd.), thereby preparing a mold release agent particle dispersion (1) with a solid content of 20%. The volume-average particle diameter of particles in the mold release agent particle dispersion (1) is 230 nm.

[Formation of Carrier]

Ferrite particle (volume-average particle diameter: 35 μm): 100 parts

Toluene: 14 parts

Styrene/methyl methacrylate copolymer (copolymerization ratio: 15/85): 3 parts

Carbon black (Cabot Corporation, Regal 330): 0.2 parts

These materials excluding the ferrite particles are dispersed by using a sand mill to prepare a dispersion, and the resultant dispersion is placed together with the ferrite particles in a vacuum degassing kneader and dried at reduced pressure under stirring, thereby producing a carrier.

<Formation of White Toner and White Developer>

Example 1

Polyester resin particle dispersion (1): 160 parts

White pigment particle dispersion (1): 75 parts

Mold release agent particle dispersion (1): 20 parts

Ion exchange water: 220 parts

Anionic surfactant (Tayca Power manufactured by Tayca Corporation): 5 parts

These materials are placed in a round-bottom stainless-made flask and adjusted to pH 3.5 by adding 0.1N nitric acid, and then 30 parts of an aqueous nitric acid solution at an aluminum polychloride concentration of 10% is added to the flask. Next, the resultant mixture is dispersed at a liquid temperature of 30° C. by using a homogenizer (Ultra-Turrax T50, manufactured by IKA Corporation), heated by heating to 45° C. at a rate of 1° C. per 30 minutes in a heating oil bath, and then maintained at 45° C. for 30 minutes. Then, 25 parts of the polyester resin particle dispersion (1) is added, and the resultant mixture is maintained for 1 hour, adjusted to pH 8.5 by adding a 0.1 N aqueous sodium hydroxide solution, and then heated to 84° C. and maintained for 2.5 hours. Next, the mixture is cooled to 20° C. at a rate of 20°

C./min and filtered, and the residue is sufficiently washed with ion exchange water and dried to produce toner particles (1). The volume-average particle diameter of the toner particles (1) is 1 μm.

Then, 2 parts of titanium dioxide particles (JMT-150FI, manufactured by Tayca Corporation) is added to 100 parts of the toner particles and mixed for 15 minutes by using a HENSCHEL MIXER at a stirring peripheral speed of 30 m/second. Then, the resultant mixture is sieved by using a vibrating sieve having an opening 45 μm, producing an external toner.

As a result of observation of the external toner with a scanning electron microscope (SEM), the external additive has a spindle shape, and the value of long diameter/short diameter obtained by the method described above is 4.5.

In a V-blender, 10 parts of the external toner and 100 parts of the carrier are placed and stirred for 20 minutes. Then, the resultant mixture is sieved with a sieve having an opening of 212 μm to produce a white developer.

Examples 2 to 8

A white toner and white developer of each of the examples are produced by the same method as in Example 1 except that the type of the white pigment particle dispersion is changed as shown in Table 1.

Example 9

A white toner and white develop are produced by the same method as in Example 1 except that the heating rate after dispersion at a liquid temperature of 30° C. is changed to 1° C. per 5 minutes.

Example 10

A white toner and white developer are produced by the same method as in Example 1 except that the amount of the polyester resin particle dispersion (1) added after maintaining at 45° C. is changed to 60 parts.

Example 11

A white toner and white developer are produced by the same method as in Example 1 except that the amount of the polyester resin particle dispersion (1) added after maintaining at 45° C. is changed to 10 parts.

Example 12

A white toner and white developer are produced by the same method as in Example 1 except that the amount of the anionic surfactant is changed to 10 parts.

Example 13

A white toner and white developer are produced by the same method as in Example 1 except that the amount of the anionic surfactant is changed to 1 part.

Example 14

A white toner and white developer are produced by the same method as in Example 1 except that the polyester resin particle dispersion (1) is changed to a dispersion (solid content of 20%) of a styrene/acrylic resin (styrene/methyl methacrylate copolymer, copolymerization ratio of 15/85).

Comparative Examples 1 and 2

A white toner and white developer of each of Comparative Examples 1 and 2 are produced by the same method as in Example 1 except that the type of the white pigment particle dispersion is changed as shown in Table 1.

<Performance Evaluation of White Toner>

[Whiteness of White Image]

By using the white toner of the example or comparative example, a white image (density of 100%, toner loading amount of 9 g/m$^2$, dimensions of 20.0 cm×28.7 cm) is formed on an OHP film (OHP film for PPC laser, manufactured by Fuji Xerox Co., Ltd., dimensions of 21.0 cm×29.7 cm).

The image-formed material is wound and unwound repeatedly 100 times by using a winding test machine (desktop-model endurance testing machine DLDMLH-FR manufactured by Yuasa System Co., Ltd., diameter: 50 mm).

Before and after the winding treatment, the image-formed material is wound around a transparent cylinder having a diameter of 100 mm so that the white image side adheres to the cylinder side, and brightness is measured by a spectral colorimeter. Specifically, the L* value (brightness) of a white image portion is measured from the OPH film side under a D50 light source by using the spectral colorimeter (X-Rite Ci62, manufactured by X-Rite, Inc.). The measured L* values are classified as described below. Table 1 shows the classes and L* values before and after the winding treatment.

A: L* value of 75 or more

B: L* value of 72 or more and less than 75

C: L* value of 69 or more and less than 72

D: L* value of 65 or more and less than 69

E: L* value of less than 65

[Color Reproducibility of Color Image]

By using a cyan toner, a blue image (density of 100%, toner loading amount of 4 g/m$^2$) is formed on paper (OS coated paper, manufactured by Fuji Xerox Co., Ltd., basis weight of 127 g/m$^2$). The L* value, a* value, and b* value of the blue image are measured under a D50 light source by using the spectral colorimeter (X-Rite Ci62, manufactured by X-Rite, Inc.). These are regarded as reference values for evaluation of color reproducibility.

By using the cyan toner used described above and the white toner of the example or comparative example, a blue image (density of 100%, toner loading amount of 4 g/m$^2$) and a white image (density of 100%, toner loading amount of 9 g/m$^2$) are laminated on an OHP film (OHP film for PPC laser, manufactured by Fuji Xerox Co., Ltd., dimensions of 21.0 cm×29.7 cm) to form a laminated image (dimensions of 20.0 cm×28.7 cm). The blue image of the laminated image is a lower layer (OHP film side).

The image-formed material is wound and unwound repeatedly 100 times by using a winding test machine (desktop-model endurance testing machine DLDMLH-FR manufactured by Yuasa System Co., Ltd., diameter: 50 mm).

Before and after the winding treatment, the image-formed material is wound around a transparent cylinder having a diameter of 100 mm so that the white image side adheres to the cylinder side, and colors are measured by a spectral colorimeter. Specifically, the L* value, a* value, and b* value of the blue image portion are measured from the OPH film side under a D50 light source by using the spectral colorimeter (X-Rite Ci62, manufactured by X-Rite, Inc.). A color difference ΔE is calculated based on a formula below and classified into A to E as follows. Table 1 shows the class and color difference ΔE before after the winding treatment.

$$\Delta E=\sqrt{(L_1-L_2)^2+(a_1-a_2)^2+(b_1-b_2)^2}$$

In the formula, $L_1$, $a_1$, and $b_1$ are the L* value, a* value, and b* value, respectively, of the blue image formed on the paper, and $L_2$, $a_2$, and $b_2$ are the L* value, a* value, and b* value, respectively, of the blue image formed on the OHP film.

A: Value of color difference ΔE of less than 1.5

B: Value of color difference ΔE of 1.5 or more and less than 3.0

C: Value of color difference ΔE of 3.0 or more and less than 5.0

D: Value of color difference ΔE of 5.0 or more and less than 8.0

E: Value of color difference ΔE of 8.0 or more

What is claimed is:

1. A white toner for electrostatic image development, the toner comprising:

white toner particles containing a binder resin and a white pigment, wherein when in a circularity distribution of the white pigment determined by sectional observation of the white toner particles, the cumulative 10% circularity from the smaller side is C10, and the cumulative 50% circularity is C50, the following formula (1) and formula (2) are satisfied, $$0.900 \leq C50 \leq 1.000 \quad \text{Formula (1):}$$

$$1.00 \leq C50/C10 \leq 1.13. \quad \text{Formula (2):}$$

2. The white toner for electrostatic image development according to claim 1, wherein the C50/C10 satisfies the following formula (2'), $$1.00 < C50/C10 \leq 1.08. \quad \text{Formula (2'):}$$

TABLE 1

| | | | White pigment | | | | | | | | | Performance evaluation of white toner | | | |
|---|---|---|---|---|---|---|---|---|---|---|---|---|---|---|---|
| | Binder resin | White pigment particle dispersion | C50 | C10 | C50/C10 | Average diameter [nm] | Area of Voronoi polygon Sa [μm²] | Area of Voronoi polygon Ssd [μm²] | Distribution of uneven distribution degrees Pm | Distribution of uneven distribution degrees Psk | BET specific surface area [m²/g] | Whiteness (L* value) of white image Before treatment | Whiteness (L* value) of white image After treatment | Color reproducibility (color difference) of colored image Before treatment | Color reproducibility (color difference) of colored image After treatment |
| Example 1 | Polyester | (1) | 0.950 | 0.910 | 1.04 | 350 | 0.242 | 0.161 | 0.94 | −0.75 | 7.5 | A:75.5 | A:75.1 | A:1.2 | A:1.4 |
| Example 2 | Polyester | (2) | 0.902 | 0.850 | 1.06 | 390 | 0.265 | 0.164 | 0.93 | −0.82 | 7.4 | A:75.5 | B:72.9 | A:1.4 | B:1.8 |
| Example 3 | Polyester | (3) | 0.995 | 0.935 | 1.06 | 314 | 0.210 | 0.150 | 0.94 | −0.71 | 7.6 | A:76.0 | A:75.2 | A:1.2 | A:1.4 |
| Example 4 | Polyester | (4) | 0.996 | 0.992 | 1.00 | 303 | 0.202 | 0.105 | 0.94 | −0.86 | 7.7 | A:75.8 | A:75.1 | A:1.1 | A:1.4 |
| Example 5 | Polyester | (5) | 0.940 | 0.872 | 1.08 | 330 | 0.235 | 0.135 | 0.93 | −0.66 | 7.5 | B:73.5 | B:72.1 | A:1.2 | B:2.5 |
| Example 6 | Polyester | (6) | 0.942 | 0.838 | 1.12 | 347 | 0.240 | 0.154 | 0.92 | −0.69 | 7.5 | B:74.1 | C:70.5 | B:2.4 | C:3.6 |
| Example 7 | Polyester | (7) | 0.970 | 0.933 | 1.04 | 335 | 0.151 | 0.135 | 0.95 | −0.71 | 7.5 | A:75.1 | B:72.8 | A:1.4 | C:3.9 |
| Example 8 | Polyester | (8) | 0.965 | 0.919 | 1.05 | 325 | 0.348 | 0.201 | 0.91 | −0.81 | 7.6 | B:73.8 | C:70.1 | B:1.6 | C:4.1 |
| Example 9 | Polyester | (1) | 0.955 | 0.910 | 1.05 | 330 | 0.250 | 0.248 | 0.93 | −0.80 | 7.2 | A:76.0 | C:71.5 | A:1.2 | C:3.9 |
| Example 10 | Polyester | (1) | 0.968 | 0.931 | 1.04 | 320 | 0.255 | 0.250 | 0.78 | −0.69 | 7.3 | B:72.5 | B:72.1 | B:2.4 | C:4.2 |
| Example 11 | Polyester | (1) | 0.970 | 0.924 | 1.05 | 330 | 0.246 | 0.241 | 0.97 | −0.67 | 7.4 | A76.0 | A:75.4 | A:1.3 | B:2.8 |
| Example 12 | Polyester | (1) | 0.955 | 0.927 | 1.03 | 342 | 0.267 | 0.235 | 0.94 | −1.09 | 7.4 | B74.3 | B:72.5 | B:2.4 | B:2.9 |
| Example 13 | Polyester | (1) | 0.959 | 0.913 | 1.05 | 336 | 0.261 | 0.249 | 0.93 | −0.61 | 7.5 | A:75.8 | B:74.5 | A:1.1 | B:1.9 |
| Example 14 | Styrene acrylic | (1) | 0.964 | 0.918 | 1.05 | 326 | 0.256 | 0.216 | 0.92 | −0.74 | 7.6 | A:75.1 | B:74.1 | A:1.2 | A:1.4 |
| Comparative Example 1 | Polyester | (9) | 0.885 | 0.815 | 1.09 | 420 | 0.302 | 0.246 | 0.95 | −0.65 | 6.4 | C:69.8 | D:65.8 | C:3.7 | E:8.1 |
| Comparative Example 2 | Polyester | (10) | 0.952 | 0.828 | 1.15 | 368 | 0.175 | 0.230 | 0.92 | −0.70 | 8.7 | B:72.6 | E:64.8 | B:2.8 | D:6.7 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

3. The white toner for electrostatic image development according to claim 1, wherein when in sectional observation of the white toner particles, the average value of the areas of Voronoi polygons generated by Voronoi division of the white pigment using the centers of gravity of the white pigment as generatrices is Sa (μm²), and a standard deviation is Ssd (μm²), the white toner satisfies the following formula (3) and formula (4), $$0.150 \leq Sa \leq 0.350 \quad \text{Formula (3):}$$

$$Ssd \leq 0.250. \quad \text{Formula (4):}$$

4. The white toner for electrostatic image development according to claim 3, wherein the Sa satisfies the following formula (3'), $$0.180 \leq Sa \leq 0.300. \quad \text{Formula (3'):}$$

5. The white toner for electrostatic image development according to claim 1, wherein when in a distribution of uneven distribution degrees of the white pigment represented by formula (A) below, the maximum frequent value is Pm and the skewness is Psk, the white toner satisfies the following formula (5) and formula (6), $$\text{Uneven distribution degree} = 2d/D \quad \text{Formula (A):}$$

$$0.78 \leq Pm \leq 0.98 \quad \text{Formula (5):}$$

$$-1.10 \leq Psk \leq -0.60 \quad \text{Formula (6):}$$

in the formula (A), D is the equivalent circle diameter (μm) of the white toner particles determined by sectional observation of the white toner particles, and d is the distance (μm) from the center of gravity of each of the white toner particles to the center of gravity of each of the white pigment particles, which is determined by sectional observation of the white toner particles.

6. The white toner for electrostatic image development according to claim 5, wherein the Pm satisfies the following formula (5'), $$0.82 \leq Pm \leq 0.96. \quad \text{Formula (5'):}$$

7. The white toner for electrostatic image development according to claim 5, wherein the Psk satisfies the following formula (6'), $$-0.90 \leq Psk \leq 0.60. \quad \text{Formula (6'):}$$

8. The white toner for electrostatic image development according to claim 1, wherein the BET specific surface area of the white pigment is 6.5 $m^2/g$ or more and 8.5 $m^2/g$ or less.

9. The white toner for electrostatic image development according to claim 1, wherein the average particle diameter of the white pigment is 200 nm or more and 350 nm or less.

10. The white toner for electrostatic image development according to claim 1, wherein the white pigment is titanium dioxide.

11. An electrostatic image developer comprising the white toner for electrostatic image development according to claim 1.

12. A toner cartridge comprising:

a container that accommodates the white toner for electrostatic image development according to claim 1, wherein the toner cartridge is configured to detachably attach to an image forming apparatus.

13. The white toner for electrostatic image development according to claim 1, wherein the C50 satisfies the following formula (1'), $$0.900 \leq C50 \leq 0.996. \quad \text{Formula (1'):}$$

* * * * *